United States Patent [19]

de Boer et al.

[11] 4,108,664

[45] Aug. 22, 1978

[54] LIGHT-SENSITIVE NEGATIVE-WORKING FILM CONTAINING A DIAZO OXIDE SENSITIZER AND A P-TOLUENESULFONYL HALIDE OR A 2,4-DIHALO-S-TRIAZINE

[75] Inventors: Henri G. J. de Boer, Delft; Gerrit van der Breggen, Krommenie; Anton Wemmers, Den Hoorn (Delft), all of Netherlands

[73] Assignee: GAF Corporation, New York, N.Y.

[21] Appl. No.: 737,566

[22] Filed: Nov. 1, 1976

[51] Int. Cl.[2] ..... G03C 1/52

[52] U.S. Cl. ..... 96/75; 96/91 D; 96/49

[58] Field of Search ..... 96/49, 91 D, 91 R, 75

[56] References Cited

U.S. PATENT DOCUMENTS

| | | | |
|---|---|---|---|
| 2,034,508 | 3/1936 | de Boer et al. | 96/91 D |
| 3,039,872 | 6/1962 | de Boer et al. | 96/91 R |
| 3,139,341 | 6/1964 | Schlesinger | 96/91 R |
| 3,775,113 | 11/1973 | Bonham et al. | 96/91 D |

*Primary Examiner*—Won H. Louie, Jr.

*Attorney, Agent, or Firm*—Walter C. Kehm; Walter Katz

[57] ABSTRACT

An improved light-sensitive negative-working diazo type film is described. The film includes a diazo-oxide sensitizer and an additive therefore which improves the actinic opacity of the image formed during the diazo process. The additive operates by reacting with the azo dye formed in the image areas. An example of such an additive is a sulfonic acid halide.

2 Claims, No Drawings

LIGHT-SENSITIVE NEGATIVE-WORKING FILM CONTAINING A DIAZO OXIDE SENSITIZER AND A P-TOLUENESULFONYL HALIDE OR A 2,4-DIHALO-S-TRIAZINE

BACKGROUND OF THE INVENTION

1. Field of the Invention

This invention relates to negative-working diazo processes, and more particularly, to an improved light-sensitive diazo film capable of being undergoing autocoupling to produce a negative print of an original having good visual properties.

2. Description of the Art

The diazo process is basically a positive printing process in that the non-image areas of an original transmit actinic radiation to the light-sensitive coating, and, in these areas, the diazo compound is decomposed. Thus, its capacity for subsequent coupling to form a dye-image is destroyed. This decomposition product usually does not react with further undecomposed parent diazo compound unless the photolysis product is reactive enough. However, under favorable conditions, it can react with non-decomposed diazo compound to form a dye in the partly exposed areas, but not in the areas protected from light. Thus a negative print of the original results.

Such a negative printing process ideally should involve a 50% decomposition of the diazo compound followed by autocoupling between the remaining half of the parent diazo compound with its decomposition product to form the desired dye-image. This autocoupling reaction can be initiated as in positive systems by increasing the pH of the substrate with a weak solution of ammonia, gaseous ammonia, or other bases. The remaining diazo if present, can be removed by a second exposure step.

The negative diazo process has not been very successful, however, because the ratio of the photolysis product to the residual diazo is difficult to control, with the result that the density of the dye-image is lower than that which is required for a commercial system.

Accordingly, it is an object of the present invention to provide a new and improved negative-working diazo printing process.

Another object of this invention is to provide a negative process which is capable of providing prints having relatively high image densities.

A further object of this invention is to provide a light-sensitive diazo material for a negative-working diazo process which is capable of undergoing autocoupling to produce a dye-image having good visual properties and high actinic density.

These and other objects of the invention are achieved herein by the provision of a negative working diazo process in which the light-sensitive layer of the diazo paper is a diazo oxide having a chemical additive therefor which significantly enhances the image density of the image dye produced in the process.

SUMMARY OF THE INVENTION

The diazo oxides themselves, used herein as primary sensitizers, are 6-diazo-5-oxo-1-naphthalenesulfonic acids and derivatives thereof, such as the esters and amides. Such compounds are described fully in U.S. Pat. Nos. 2,702,243 and 2,772,972 and British Pat. No. 889,363. Representative compounds in this class include 6-diazo-5-oxo-1-naphthalene sulfonylchloride, and derivatives formed therewith formed by esterification or amidation with aliphatic or aromatic alcohols or amines. For example, the ethyl or phenyl ester of 6-diazo-5-oxo-1-naphthalene sulfonic acid is a diazo oxide within the meaning of this term. Similarly, N-B-hydroxyethyl-6-diazo-5-oxo-1-naphthalenesulfonamide is a diazo oxide which may be used as a primary light sensitive material in this invention. Other examples of suitable diazo oxides are described in the aforementioned patents.

As a feature of the present invention, the actinic properties of diazo oxides are enhanced considerably by the incorporation therewith of a chemical additive which reacts with the azo dye formed in the negative working process to provide prints of improved visual and actinic densities. The additives used in the present invention are chemical compounds which themselves do not undergo coupling during the development step, but whose presence improves the quality of the dye image. Suitable classes of compounds include acyl and sulfonyl halides; S-triazines and derivatives thereof, and halogenated pyrazines, halogenated pyridazines, halogenated pyrimidines, and derivaties thereof. Preferred compounds within these classes are p-toluenesulfonylchloride and 2,4-dichloro-6(4'-hydroxyphenylamino)-S-triazine.

DETAILED DESCRIPTION OF THE PREFERRED EMBODIMENT

In general, the light-sensitive films of the present invention are prepared by first providing a support, as for example, a suitable transparent or translucent material. Suitable materials for this purpose include cellulose esters and resins, such as saturated polyesters, polystyrene, polyvinyl chloride, polyvinyl acetate and the like, or translucent paper.

The support then is coated with a carrier material, such as a copolymer of an allyl vinyl ether and maleic anhydride, in a mixture with another polymer or copolymer compatible therewith. The other polymer or copolymer may be a cellulose ester, a polyvinyl resin or a copolymer of a vinyl compound, such as styrene or vinyl acetate, with an unsaturated dicarboxylic acid, such as maleic acid and crotonic acid.

The light-sensitive layer then is applied from a solution comprising the diazo oxide and the additive. Preferably the solution also includes a resinous polymer or copolymer compatible therewith. Suitable examples of such polymers and copolymers include polyvinylacetate, polyisobutylene, butyl methacrylate, cellulose esters, as for example, cellulose acetate and cellulose propionate, cellulose ethers, and copolymers of ethenoid compounds, such as vinyl acetate with unsaturated dicarboxylic acids, such as maleic acid.

The light-sensitive layer can be stabilized, if necessary, with an acid compound, as for example a non-reactive inorganic acid, when the diazo oxide itself is not sufficiently acid to stabilize the layer itself. A preferred acid for this purpose is citric acid, although any non-reactive acid may be used as well.

The solvent may be any suitable commercial solvent or mixture of solvents which will dissolve the resinous materials. Examples of suitable solvents include methyl cellulose, acetone, methylene chloride, dioxane, tetrahydrofuran, cyclohexanone, methylethylketone, and the like. The quantity of the solvent however, is not critical.

After applying the solution to the support, the solvent is evaporated to provide a dry, light-sensitive layer, which preferably ranges in thickness from about 0.1 to 0.4 mils, and most preferably is about 0.2 mils thick. As mentioned, the light-sensitive layer may comprise the diazo oxide sensitizer and additive therewith alone, or it maybe include also one or more polymers or copolymer resins.

The film thus-formed then is exposed with ultraviolet light to partially decompose the sensitizer corresponding to the non-image areas of the film. Following the exposure step, the images are developed with a basic developing agent, e.g., ammonia. The dye-image then is formed between the diazo oxide decomposition products and the still-remaining diazo oxide sensitizer by autocoupling.

After development, the film may be subjected to a second light exposure step to fix the dye-image. This second exposure step burns out all sensitizer still present in the non-image areas of the film, and thereby increases the shelf-life of the film material.

The proportions of sensitizer and additive components in the solution may vary widely. Preferably, about 5 to 15 parts by weight of the sensitizer and 1 to 15 parts by weight of the additive in a resinous solution is used. A typical formula has a ratio of 2 moles of sensitizer to 1 mole of additive, although other ratios may be used as well. The invention is described hereinafter with reference to the following specific examples.

EXAMPLE I

Ethyl 6-diazo-5-oxo-1-naphthalensulfonate; 8.0 g
2,4-Dichloro-6(4'-hydroxyphenylamine)-S-triazine; 3.5 g
Citric acid; 2.5 g
Cellulose acetate-propionate; 30.0 g
Methylethylketone; 180.0 g A sensitizer-additive-resin solution of the above formulation is prepared by admixing the components. The solution then is applied to Melinex 505, (a trademark product of I.C.I.) which is a polyester resin support material, on a 1.0 mm. wire-wound rod. The film thus-formed is exposed with ultraviolet radiation and developed with ammonia gas. After drying, a yellow-colored dye image having a high actinic opacity is obtained.

The procedure given above is repeated without the S-triazine additive compound in the sensitizing solution. The dye-image produced has relatively poor actinic opacity.

As an alternative procedure, the cellulose acetate-propionate resin in methylethylketone is applied first to the resin support followed by application of the sensitizing-additive solution. A film having a correspondingly high actinic opacity is obtained.

EXAMPLE II

Ethyl 6-diazo-5-oxo-1-naphthalenesulfonate; 8.5 g
P-Toluenesulfonylchloride; 4.0 g
Citric acid; 2.5 g
Cellulose acetate-propionate; 30.0 g
Methylethylketone; 140.0 g
Methylglycolacetate; 30.0 g A sensitizer-additive-resin solution of the formulation given above is applied to Melinex 542 (trademark of I.C.I.), a polyester base, using a 1.0 mm wire-wound rod. After exposure and ammonia development of the dried film, a yellow-colored dye-image having a high actinic opacity is obtained.

The procedure given above is repeated without the p-toluenesulfonylchloride additive in the sensitizing solution. The dye-image thus produced exhibits relatively poor actinic opacity.

EXAMPLE III

N-p-Hydroxyethyl-6-diazo-5-oxo-1-naphthalenesulfonamide; 10 g
3-Phenylamino-5,6-dichloropyridazine; 4.3 g
Cellulose acetate-propionate; 60.0 g
Methylethylketone; 180.0 g
Dimethylformamide; 40.0 g The sensitizer-additive-resin solution having the formulation given above is applied to Melinex 505 (trademark I.C.I.) a polyester resin. After exposure and ammonia development of the dried film, a colored dye image having good visual density and high actinic opacity is obtained.

The procedure given above is repeated without the 3-phenylamino-5,6-dichloropyridazine additive in the sensitizing solution. The dye-image produced has relatively poor actinic opacity.

EXAMPLE IV

N-p-Hydroxyethyl-6-diazo-5-oxo-1-naphthalenesulfonamide; 10.0 g
Diphenylcarbamylchloride; 2.0 g
Cellulose acetate-propionate; 80.0 g
Methylethylketone; 200.0 g
Dimethylformamide; 60.0 g The sensitizer-additive-resin solution of the above formulation is applied to a 1.0 mm wire-wound rod coated with the Melinex 505 (I.C.I.) a polyester. After ultraviolet exposure and ammonia development, a colored dye-image having good visual density and high actinic opacity is obtained. After development, the image is given a second ultraviolet exposure to burn out the non-image areas of the film.

The procedure given above is repeated without the diphenylcarbamyl additive compound in the sensitizing solution. The dye-image produced has relatively poor actinic opacity.

The additives of the present invention not only provide prints having improved contrast densities but they also stabilize the system so that the diazo films possess a longer shelf-life than films having diazo oxide sensitizer alone in the light-sensitive layer of the film. In addition, the actinic opacity of the image formed is sufficient so that the film can be used as an intermediate master or duplicate original for offset plates or graphic arts templates.

While the invention has been described with particular reference to certain embodiments thereof, it will be understood by those skilled in the art that certain modifications and changes may be made which are within the skill of the art, and it is intended to be bound by the appended claims only.

What we claim is:

1. A light-sensitive negative working diazo type film comprising:

a. a support,
b. a carrier coating thereon, and,
c. a light-sensitive layer including a diazo oxide sensitizer and an additive therefor, wherein said additive is p-toluenesulfonylchloride or 2,4-dichloro-6-(4'-hydroxyphenyl-amino)-S-triazine, the proportions of sensitizer to additive being about 5–15 parts by weight to about 1–15 parts by weight, respectively.

2. A film according to claim 1 wherein the diazo oxide is an ester or amide of 6-diazo-5-oxo-1-naphthalenesulfonic acid.

* * * * *